US011377809B2

(12) United States Patent
Prest

(10) Patent No.: US 11,377,809 B2
(45) Date of Patent: Jul. 5, 2022

(54) BAIL-ACTUATED MULTI-FACETED STAKING SYSTEM AND METHOD

(71) Applicant: PREST-O-FIT MANUFACTURING, INC., Chandler, AZ (US)

(72) Inventor: J. David Prest, Tempe, AZ (US)

(73) Assignee: PREST-O-FIT MANUFACTURING, INC., Chandler, AZ (US)

( * ) Notice: Subject to any disclaimer, the term of this patent is extended or adjusted under 35 U.S.C. 154(b) by 0 days.

(21) Appl. No.: 17/061,530

(22) Filed: Oct. 1, 2020

(65) Prior Publication Data

US 2022/0106759 A1 Apr. 7, 2022

(51) Int. Cl.
*E02D 5/80* (2006.01)
*E04H 15/62* (2006.01)
*E04H 15/32* (2006.01)

(52) U.S. Cl.
CPC ..... *E02D 5/80* (2013.01); *E04H 15/62* (2013.01); *E04H 15/32* (2013.01)

(58) Field of Classification Search
CPC ..... E02D 5/80; E02D 2600/30; E04H 15/62; E04H 12/2215; E04H 15/32; E04H 17/265; B25C 11/00
USPC ..... 52/155, 156, 158–160, 162–166, 745.21
See application file for complete search history.

(56) References Cited

U.S. PATENT DOCUMENTS 1,550,276 A * 8/1925 Nilson ..... E02D 5/803 52/158
2,647,718 A * 8/1953 Disera ..... E04H 15/62 248/508
4,699,165 A * 10/1987 Barzana ..... E04H 15/62 135/118
4,727,693 A * 3/1988 Rockenfeller ..... E02D 5/803 52/163
5,052,659 A * 10/1991 Bates ..... E04H 17/265 254/29 R
5,197,506 A * 3/1993 Morin ..... E04H 12/20 135/118
5,243,795 A * 9/1993 Roberts ..... E02D 27/00 405/244
7,021,245 B2 * 4/2006 Johnson ..... B60N 2/2809 119/786
7,047,696 B2 * 5/2006 DiDomenico ..... E02D 5/80 52/155
7,281,349 B1 * 10/2007 Bolstad ..... A01M 23/245 43/58
8,465,004 B1 * 6/2013 Fly ..... B25B 27/02 254/30

(Continued)

FOREIGN PATENT DOCUMENTS

DE 823336 * 11/1952

*Primary Examiner* — Basil S Katcheves
*Assistant Examiner* — Omar F Hijaz
(74) *Attorney, Agent, or Firm* — Bycer & Marion, PLC; Matthew L. Bycer; Michael B. Marion

(57) ABSTRACT

A staking system includes a multifaceted support, each of the faces including a separate aperture to allow a stake to mount therethrough at varying angles. The support may be made of two separable elements. A bail is hingedly mounted in the support and set between various positions over the top of the support. A puller can be used to cause lever-action removal of the stake from the ground, and the pullet may be adjected to various distances. The support may be rotated along the ground surface to provide better attack angles for the lever-actuated removal.

22 Claims, 23 Drawing Sheets

(56) References Cited

U.S. PATENT DOCUMENTS

| | | | | |
|---|---|---|---|---|
| 8,479,757 | B2 * | 7/2013 | Zhou | E04H 15/62 135/118 |
| 9,133,594 | B2 * | 9/2015 | Hurley | E02D 5/80 |
| 9,611,669 | B2 * | 4/2017 | Dawson | E04H 15/62 |
| 2004/0148878 | A1 * | 8/2004 | Somerville | A01G 17/14 52/165 |
| 2009/0007502 | A1 * | 1/2009 | Roy | E02D 5/80 52/159 |
| 2015/0225977 | A1 * | 8/2015 | Dawson | B25B 27/04 254/199 |

* cited by examiner

BAIL-ACTUATED MULTI-FACETED STAKING SYSTEM AND METHOD

BACKGROUND OF THE INVENTION

1. Field of the Invention

The present invention relates to ground staking systems. The present invention more particularly relates to stake securing systems with lever action removal.

2. Description of Related Prior Art

Various staking systems are well known in the art to secure items into the ground. For instance, a stake is driven through a loop, grommet, or washer, to secure a tarp, tent, or other item, into a ground surface. Staking systems have been used including, simple straight stakes, and well as more complicated piercing shafts that include a head or other removal feature at the top end. Methods for direct removal of stakes suffer the problem of requiring a directed force, often equivalent to the force required to drive the stake into the ground. Alternative stake heads may be used, however, complicated and heavy equipment may be required to provide lever action removal. In addition, large levered stake removal systems may cause tripping hazards.

It is also well known that ground surfaces may not be contoured with simply flat planes. The angle required to secure a tent, or other feature, e.g. rope, may also require forces that are not perpendicular to the ground surface. For instance, when staking a large overhead tent with a rope at seventy-five degrees (75°) from the ground surface, a stake driven directly perpendicular to ground surface may prematurely be pulled out of the ground. Some have compensated by driving stakes at a set angle into the ground, however, the lack of a secure base may still result in the stake pulling out of the ground.

It is therefore an object of the present invention to provide a stake unit system that allows for a variety of anchoring angles.

It is another object of the present invention to provide for a fulcrum-based lever action removal option in a staking system.

It is a further object of the present invention is to provide a low-profile staking system.

These and other objects of the present invention will be clarified in the following description.

SUMMARY OF THE INVENTION

The present invention is directed to a stake system for securing items into a ground, or flooring, surface. A support will have at least one hole, channel otherwise aperture extending through the support from the top to the bottom. The support may have two or more parts (if not a uniform body) wherein the upper and lower allow the channel(s) to continue therethrough. The upper and lower may be joined via complementary dovetails, adhesive, etc. A stake, with a shaft somewhat narrower than the channel will be thrust, hammered, screwed, or otherwise forced through the support from the top to the bottom, the point of the stake mating and piercing the ground surface. The top of the stake may have a head that is sized slightly larger than the opening of the channel in the support to allow removal of the stake by pulling up on the support. The support may have one or more faces, each face oriented at a specific angle (preferably at least 5 degrees different from one another). Each face preferably has a perpendicular channel. The channel may intersect, but preferably are separate within the support. Three faces are preferred with a center face parallel to the ground, and first face offset by fifteen degrees, and a third face off by thirty degrees, each of the two offset faces mating at an edge with the center face.

To remove the support, a bail may be mounted into the support at a hinge point. Preferably the bail can be rotated from one side to the other over the face(s) of the support. The bail may be curved wire with hook end(s), a simple loop, or otherwise. The bail may be set flat at one or both sides, and held in place by nubs off the sides of the support.

A puller, a stick, handle, or otherwise, can be used to remove the device. The puller is set through the bail and anchored at the ground/floor opposite the near end. The far end, into the ground allow lifting force. Lever action is created as the near end can be lifted, forcing the puller to rotate around the bail (as a fulcrum) forcing the support upwards. As the support rises, the stake head is caught/held by support and the stake is lifted out of the ground. As the stake is lifted, the user may orient the puller, to draw in or out of the bail as may be necessary to adjust the orientation and length of each side of the bailed lever. Before removal, the support may be rotated in parallel (or near parallel) with the ground surface to allow the bail to rise in another direction. The near end of the puller may include a handle. Puller near end may include a cap and aperture system.

The present invention also includes a method for staking and removing the take form the ground. The support is set onto the ground surface, and a stake is driven through a channel in the support into the ground. The tip of the stake enters the ground, and a top head of the stake may be anchored at the support face. A bail may be included or mounted on to the support, so that a puller may be used to pull out the support/stake. The puller is fed through the bail and anchored on the ground causing lever action when the near end of the puller is pulled upwards. As the stake and support are partially lifted, the puller may be adjusted and the location of the anchoring of the far end may be repositioned to get a better angle. Prior to removal, the support may be turned along the ground surface to allow a better attack angle (and not force one to anchor the far end into something unwanted). The support may be used again and again for future staking sites.

BRIEF DESCRIPTION OF THE DRAWINGS

The present invention will be described with greater specificity and clarity with reference to the following drawings, in which.

DETAILED DESCRIPTION OF THE PREFERRED EMBODIMENT

The present invention relates to a variety of staking systems, preferably those allowing a variety of staking angles. The present invention also includes variable lever action removal systems. In some embodiments of the present invention, a multi-faceted, or more preferably a three-faceted, support may be used to provide a multitude of angles for staking. The multiple faces, each providing a separate approach angle, allow for selection of an appropriate staking angle to accommodate various attachments, such as tarps, tents, ropes, etc. on both even or uneven ground surfaces. The unit preferably includes a rounded base to allow for rotation around a driven stake, to allow lever-action removal at an appropriate bail orientation.

Figure 1:
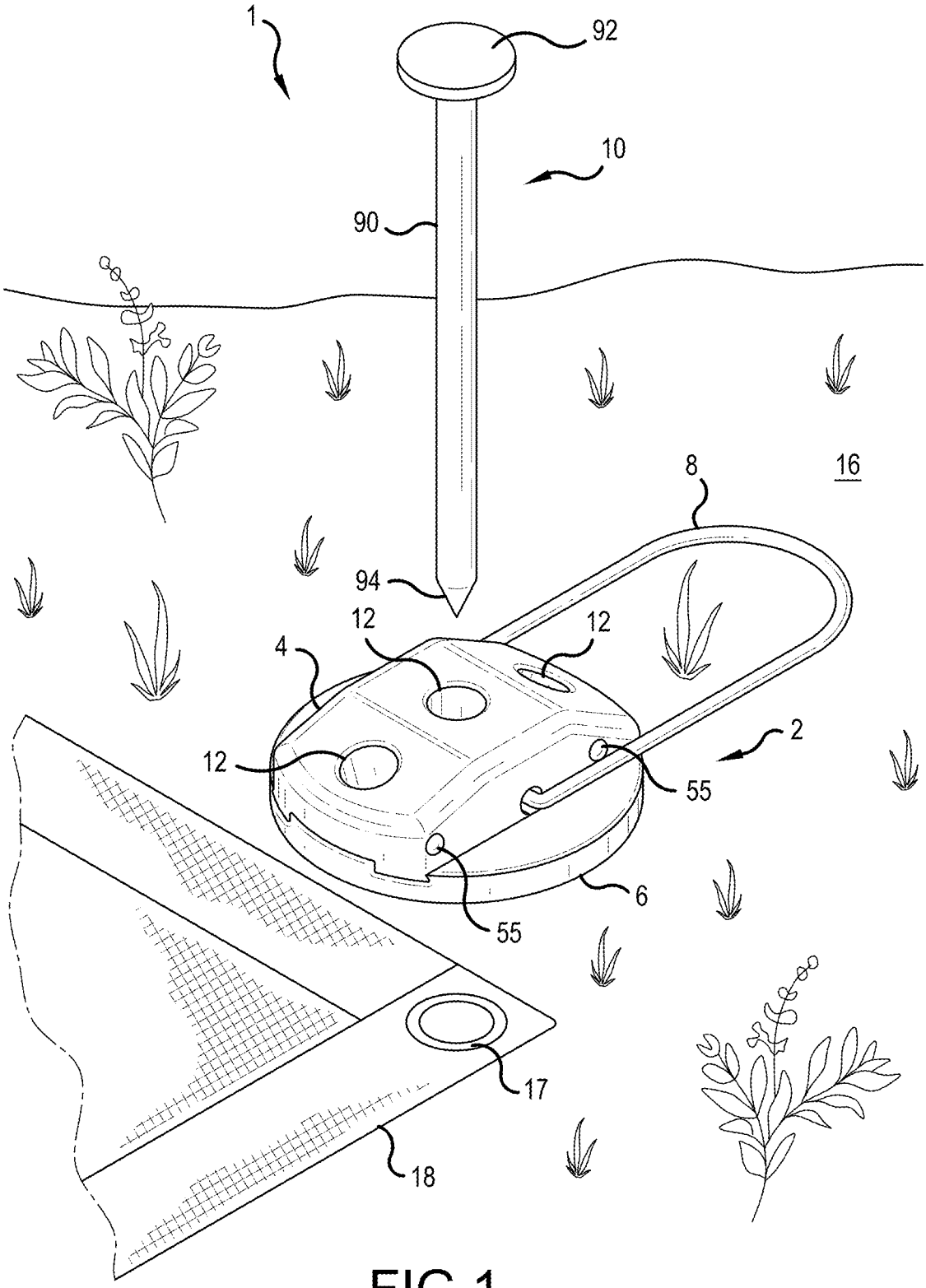
FIG. 1 illustrates a perspective view of the stake unit system before application to a standard ground-based application.

As shown in FIG. 1, stake unit 1 includes a support 2 acting as a washer or grommet in prior art staking systems. Support 2 includes upper 4 and lower 6. Bail 8 is preferably attached along upper 4, and secured into upper 4 at hinge points 50. Hinge points 50 allow bail 8 to rotate relative support 2. Nubs 55 may be included to secure bail in a down position (as shown in FIG. 1). Stake unit 1 may be employed over a ground surface 16 such as over a grommet 17 along an edge of a tarp 18. Stake 10, having standard flat head 92, shaft 90, and point 94, can be driven through one of a selection of guides 12 through support 2 and through grommet (in this embodiment) to secure support and tarp into the ground.

Figure 2:
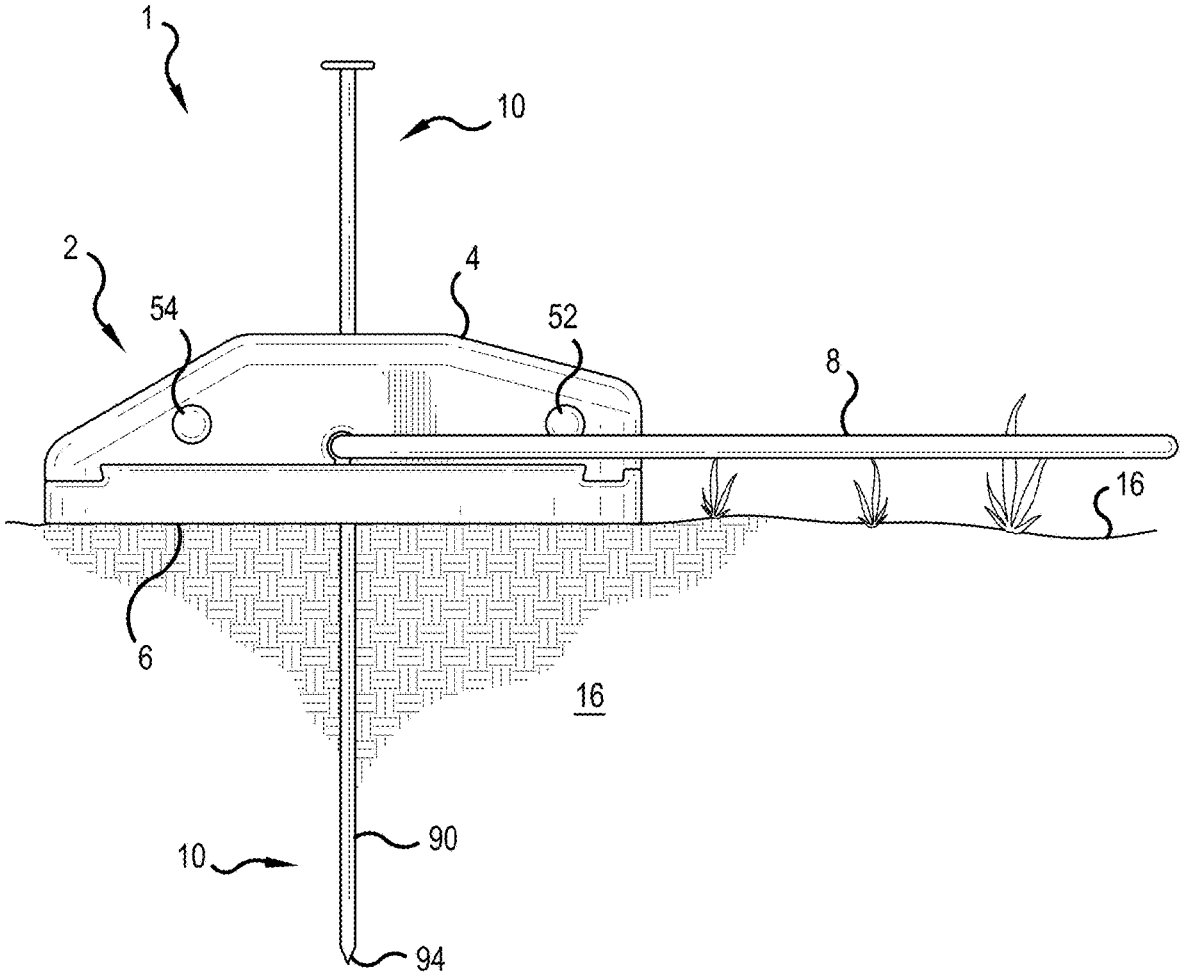
FIG. 2 illustrates a side view of the stake unit system being applied to a ground surface.
Figure 3:
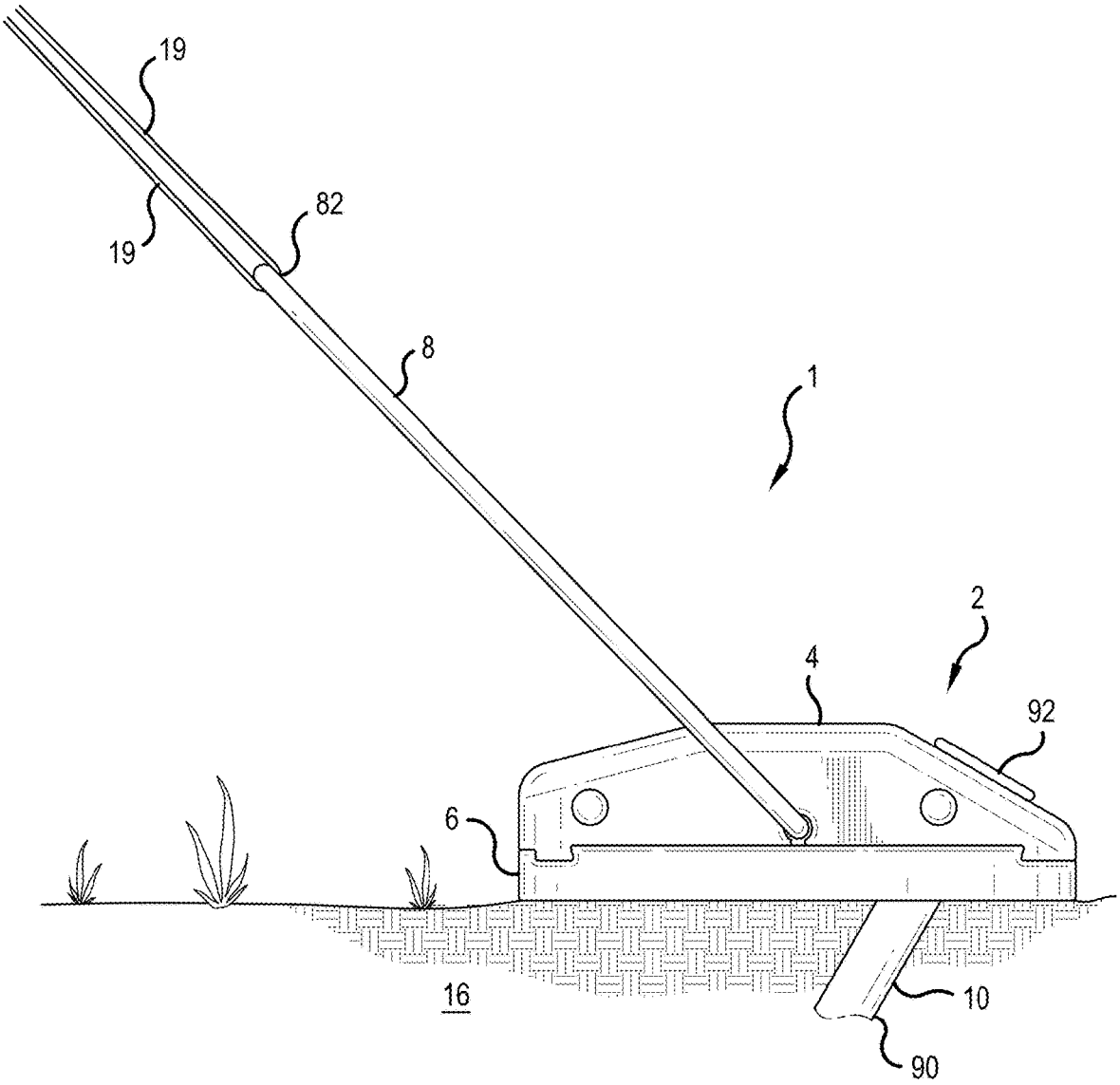
FIG. 3 illustrates a side view of the stake unit system installed in a ground and attached to a cord.

As shown in FIG. 2, a side view of the support with stake partially hammered, or otherwise forced, into ground surface 16 in a perpendicular/vertical fashion, e.g. stake 10 is set through central upper guide 47 (see FIG. 11, etc. below). Bail 8 is set down at a direct horizontal position and secured via forward nub 52 (as opposed to rear nub 54). Upper 4 and lower 6 are secured to one another.

Figure 4:
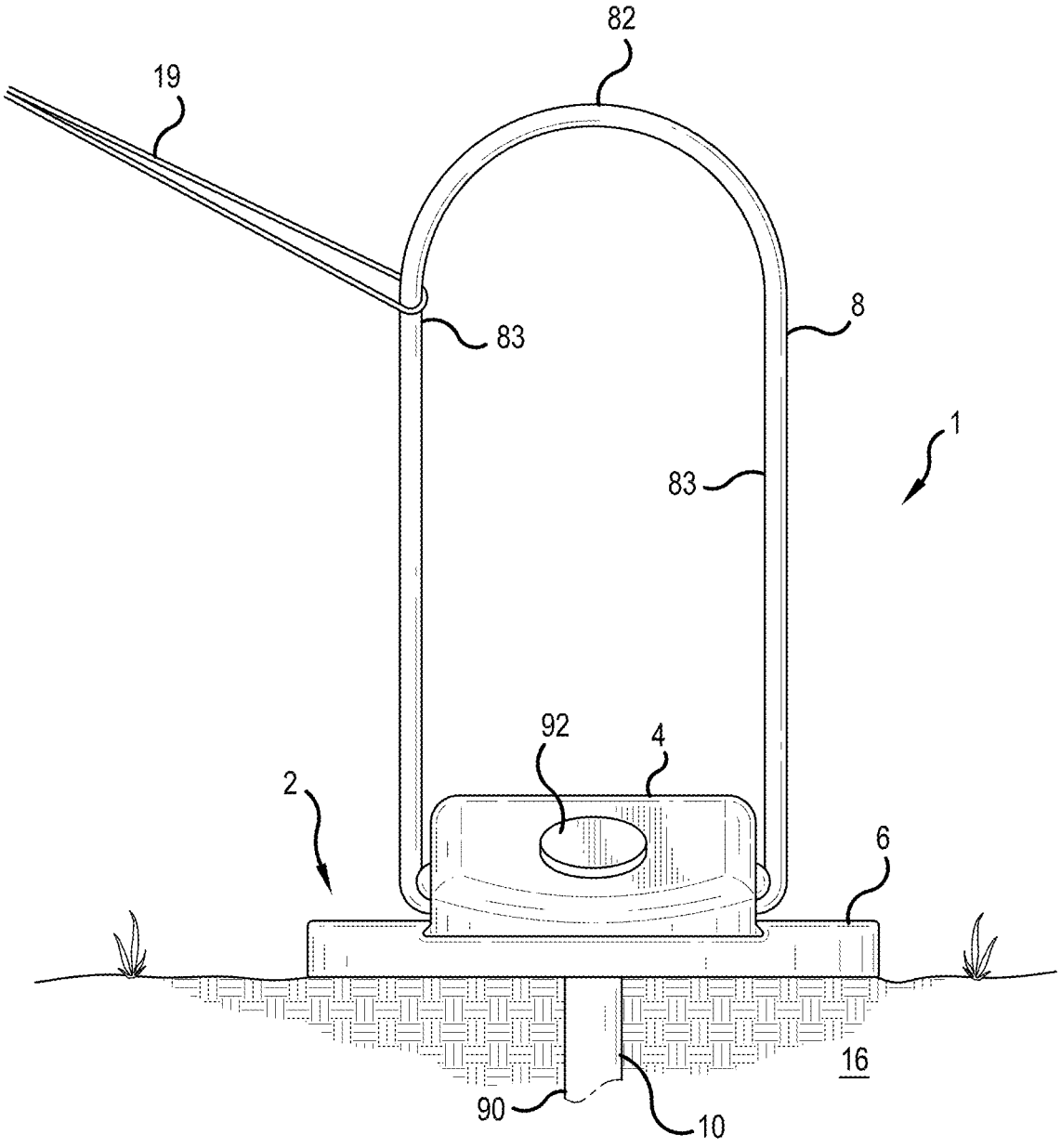
FIG. 4 illustrates a frontal view rotated ninety degrees (90°) from FIG. 3 illustrating the stake unit system applied to a ground surface and attached to a cord.

As shown in FIGS. 3-6, support 2 may be used to secure tent rope 19, or cord, wrapped around bail 8 at peak 82. Fixing stake into ground will secure support 2 onto ground surface via stake head 92 (preferably slightly larger than guide 12 opening diameter). Engaged bail 8 defines a bail axis 111 in line with cord 19. Bail axis 111 corresponds to rope the angle of the rope being drawn via longitudinal force to secure some item, such as an overhead tent, or otherwise. Stake may be driven through rear steep guide 48 to provide a near ninety degrees (90°) angle of stake relative bail axis 111 to provide maximum security of support against ground 16 (See FIG. 3). When removal of staking system is required, upon removing support 2 from ground 16, it may become necessary to rotate support ninety degrees (90°) to provide an optimal angle for a puller or stick for lever action removal (See FIGS. 4, 6, etc.). As can be seen in FIG. 4, support is rotated ninety degrees (90°) such that rope angle along rope axis 113 is now perpendicular bail axis, and rope fits along bail 8 somewhere other than peak 82, such as side 83.

Figure 5:
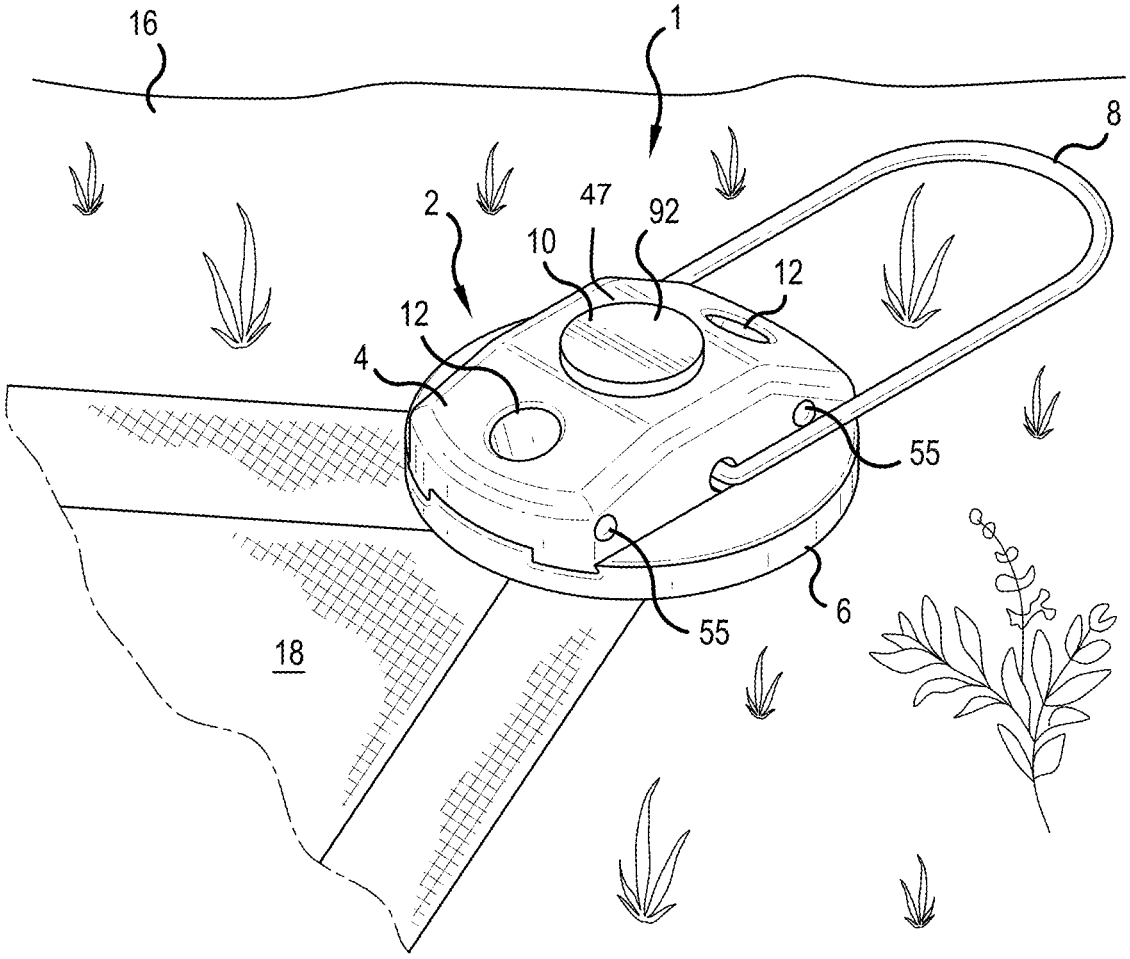
FIG. 5 illustrates a top perspective view of the stake unit applied over a tarp on a ground surface.
Figure 6:
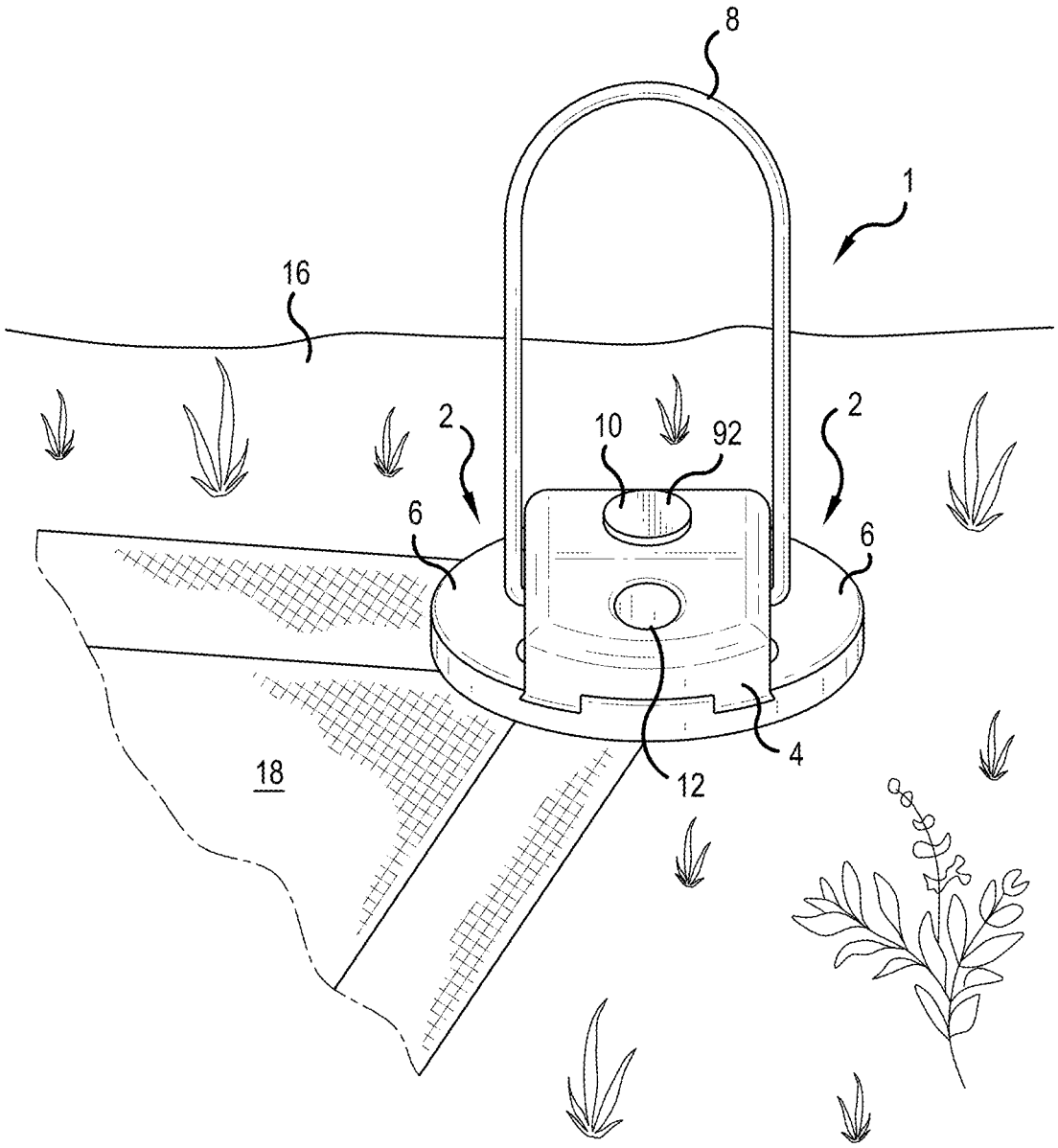
FIG. 6 illustrates the stake unit applied to the ground surface of FIG. 5 wherein the stake unit is rotated ninety degrees (90°).

Similarly, when securing a tarp to the ground via a grommet, as shown in FIG. 5, center guide 47 may be used to secure stake 10 through support 2 into the ground. As shown in FIG. 6, bail 8 may be used as a handle to rotate support ninety degrees (90°) to allow for lever action removal wherein the user does not have to stand on the tarp or use a portion of the tarp in lever action for removal.

Figure 7:
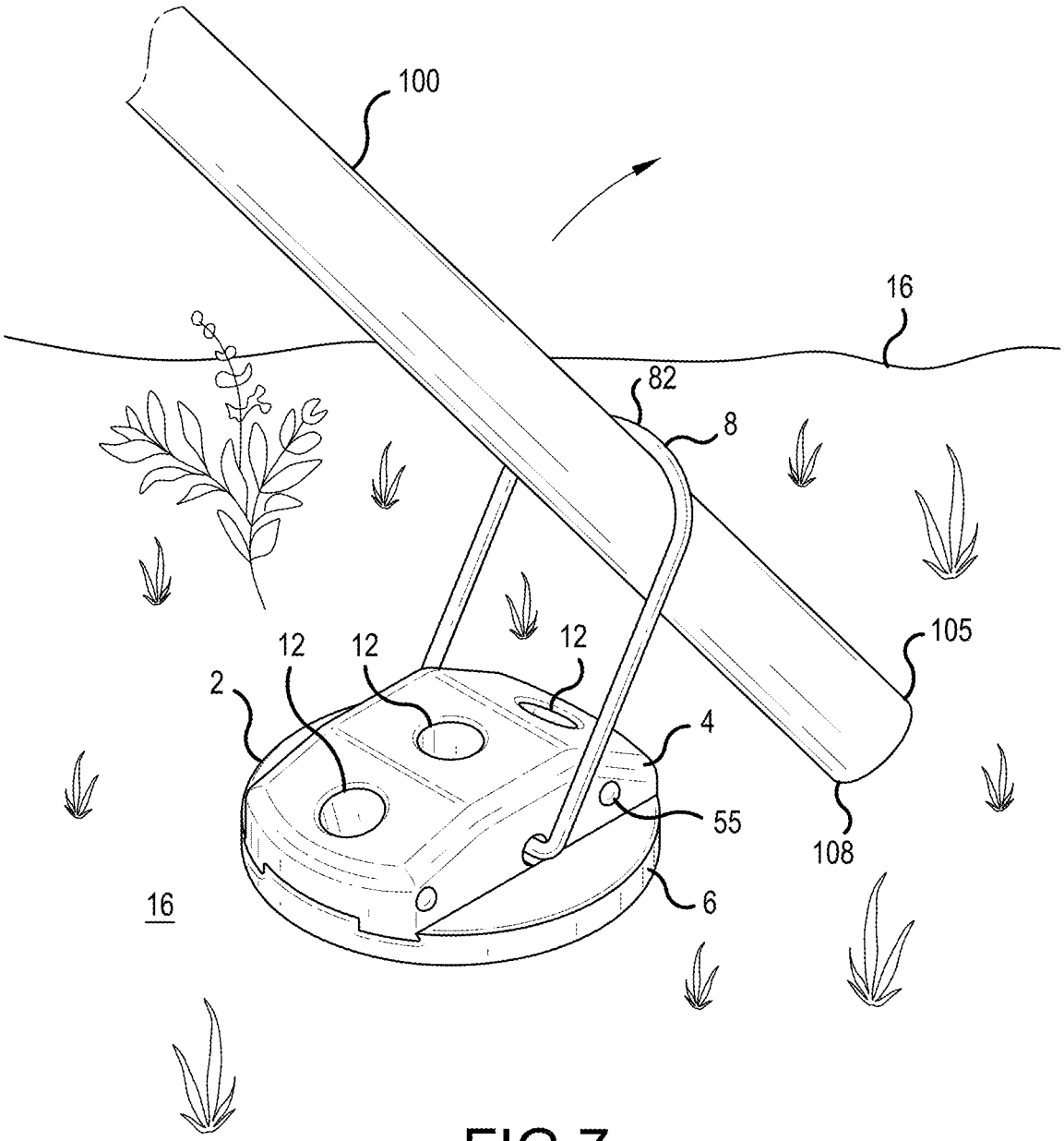
FIG. 7 illustrates a top perspective view of the stake unit applied to the ground with a puller applied through the bail.

As shown in FIG. 7, a secured support 2 into ground surface 16 may be removed via puller 100 placed through bail and affixed to ground surface at point 108 along ground. Puller 100 may be a shaft, pole, tube, cylinder, stick, or otherwise that can provide lever action, whereby a fulcrum is provided along bail 8 at bail peak 82 against a surface 16 of puller 100. Fulcrum acts to allow load point on ground 108 a distance from fulcrum 96 so that a class one lever is provided. By forcing near end 103 forward, far end 105 is forced backwards and held in place by ground surface thereby causing a translation of forces into a vertical vector that pulls support out of ground.

Figure 8:
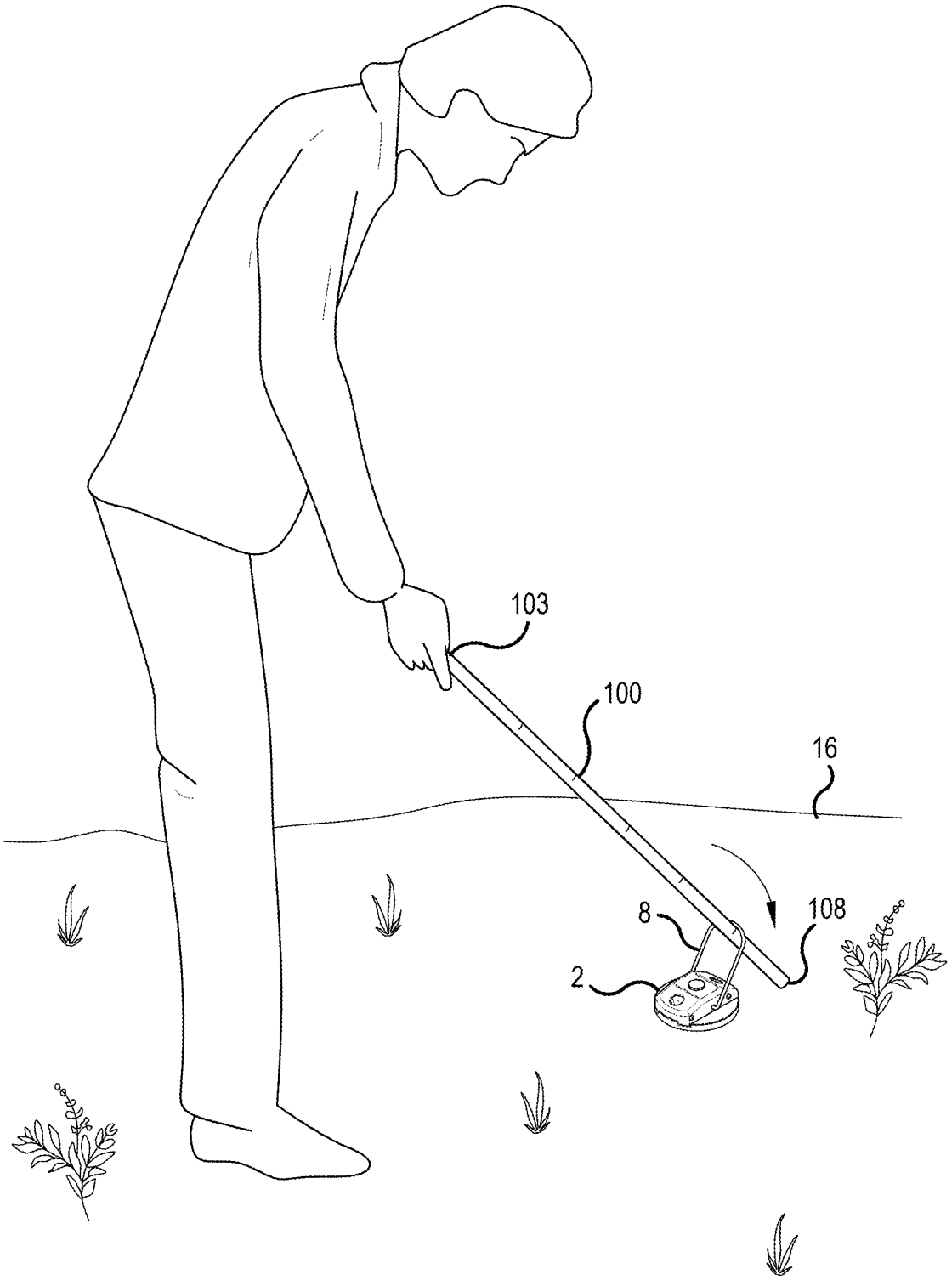
FIG. 8 illustrates the stake unit applied to the ground with a user operating the puller as a lever against the bail.
Figure 9:
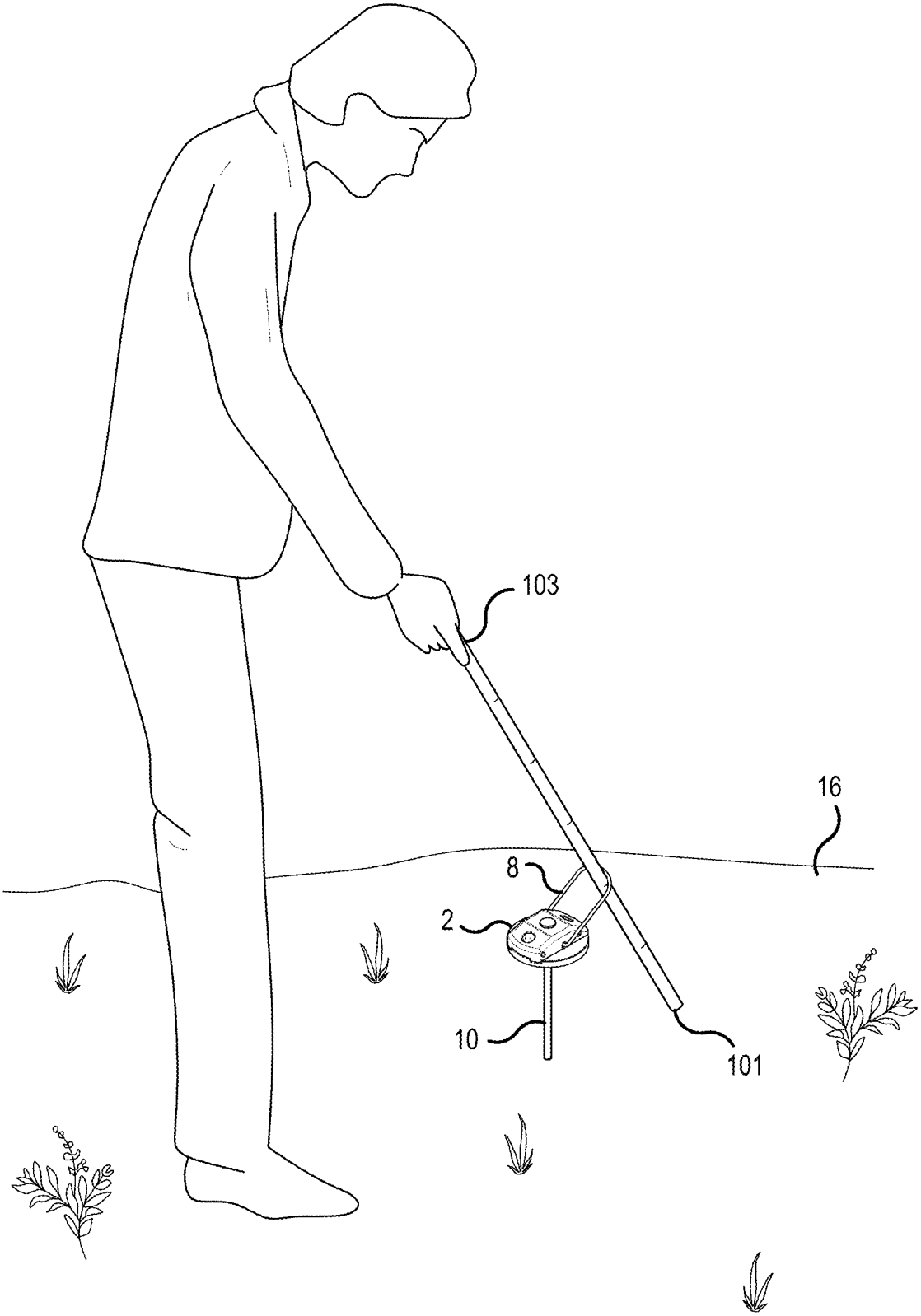
FIG. 9 illustrates the user applying the puller to partially remove the stake unit from the ground surface.

As shown in action in FIGS. 8 and 9, a user may hold near end 103 to provide lever action over fulcrum % whereas far end 105 is placed along load point 108 on ground surface 16. Fulcrum 96 is shown at anchor point 98 (on ground) in FIG. 8 and anchor point 99 (on ground) in FIG. 9. As lever action translates into vertical vector force lifting support 2 directly up off of ground surface 16, stake 10 is exposed. An alternative angle of attack may be required whereby puller can be forced through bail to modify load arm and effort arm in this class one lever system. In this manner, one may adjust the length of the puller stick to allow for continuously modifiable levers in an ergonomic fashion as the user prefers.

Figure 10:
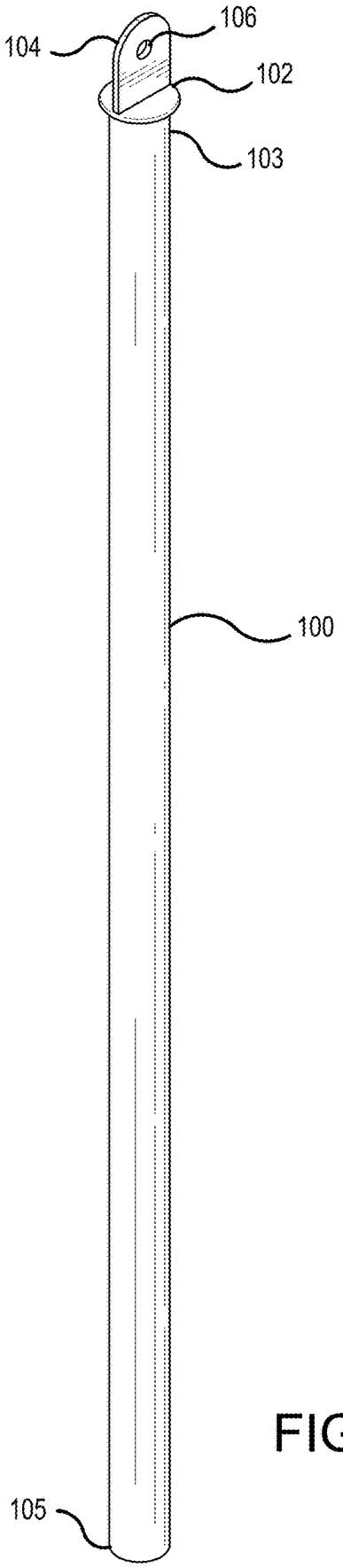
FIG. 10 illustrates a perspective view of the puller bar.

FIG. 10 illustrates the puller of an embodiment of the present invention. Puller is preferably a long cylindrical pull or pipe. In some embodiments, puller may be hollow, such as a tube, and in other embodiments, puller may be a solid cylinder. In other preferred embodiments, puller may include an exterior tubing filled with a solid interior tubing, such as PVC plastic over wood dowel. Cap 102 is provided at near end 103, and cap includes tab 104 with aperture 106. Aperture 106 allows for puller to be hung on a protruding hook, or pin, for storage or display. Cap is preferably a soft material, such as silicone or rubber, but may be made of a solid hard material such as plastic or metal or wood, etc. In alternative embodiments, puller cap 102 may be in the form of an ergonomic handle.

Stake 10 may include shaft 90 with head 92 on a top side and point 94 opposite head. Point is preferably sharpened to allow for penetrating ground or floor surfaces. Head 92 is preferably a flat flanged head, wherein the shaft 90 of stake 10 is at least somewhat narrower than guides 12 in support to allow stake to pass through guides. However, it is preferable that stake head 92 includes a flat surface that is wider than guides, yet not too wide so as to inhibit movement of bail. Bail 8 preferably can rotate at least one-hundred and eighty degrees (180°) from a first forward down position to a second rear down position. Preferably, support includes a low profile when bail is set at a forward or rear low position to prevent tripping hazards. In some embodiments, bail may be rotatable 190°-240° to allow bail to sit on ground surface.

Figure 11:
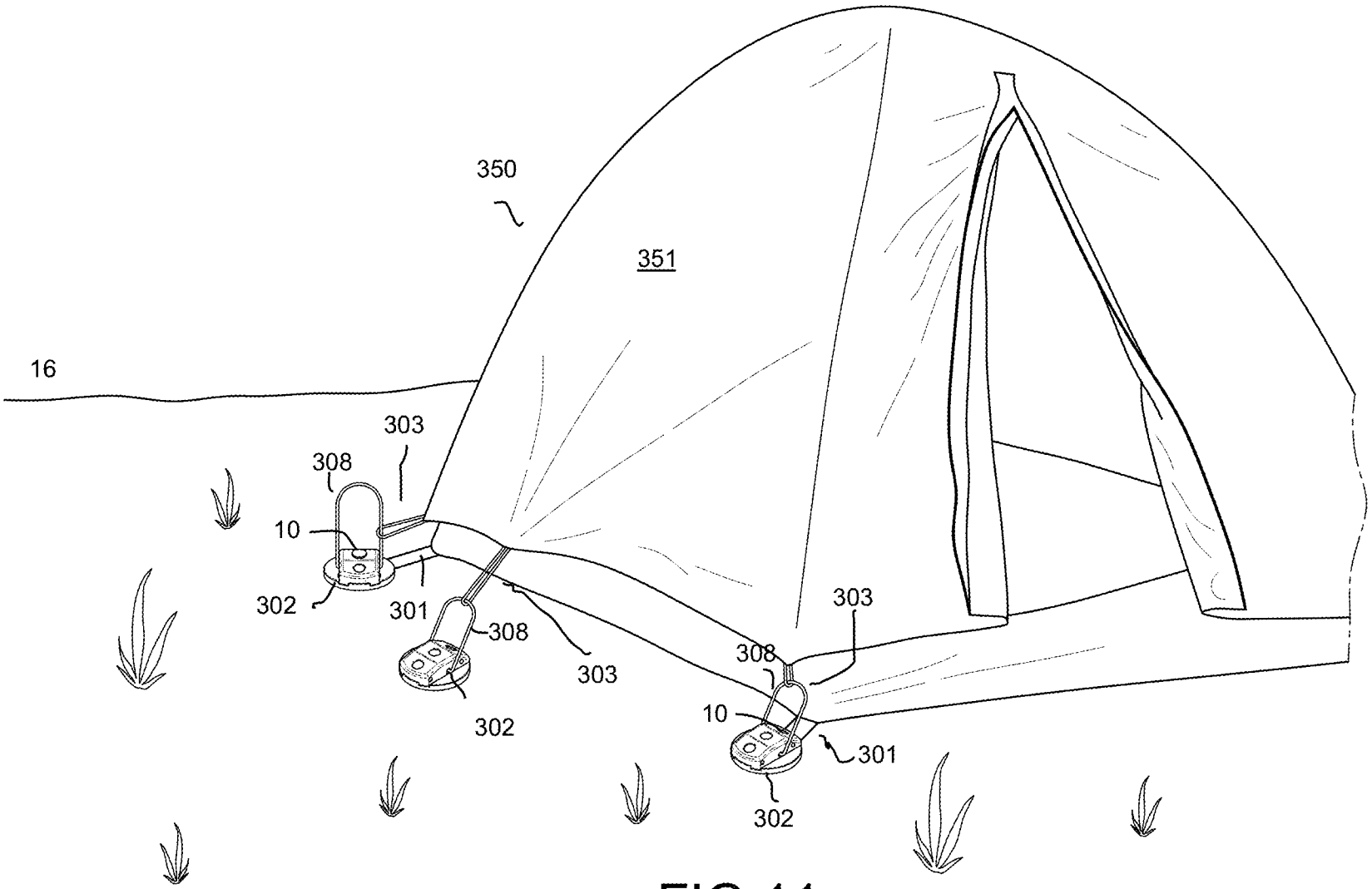
FIG. 11 demonstrates three embodiments of the present invention applied to secure a tent.
Figure 12:
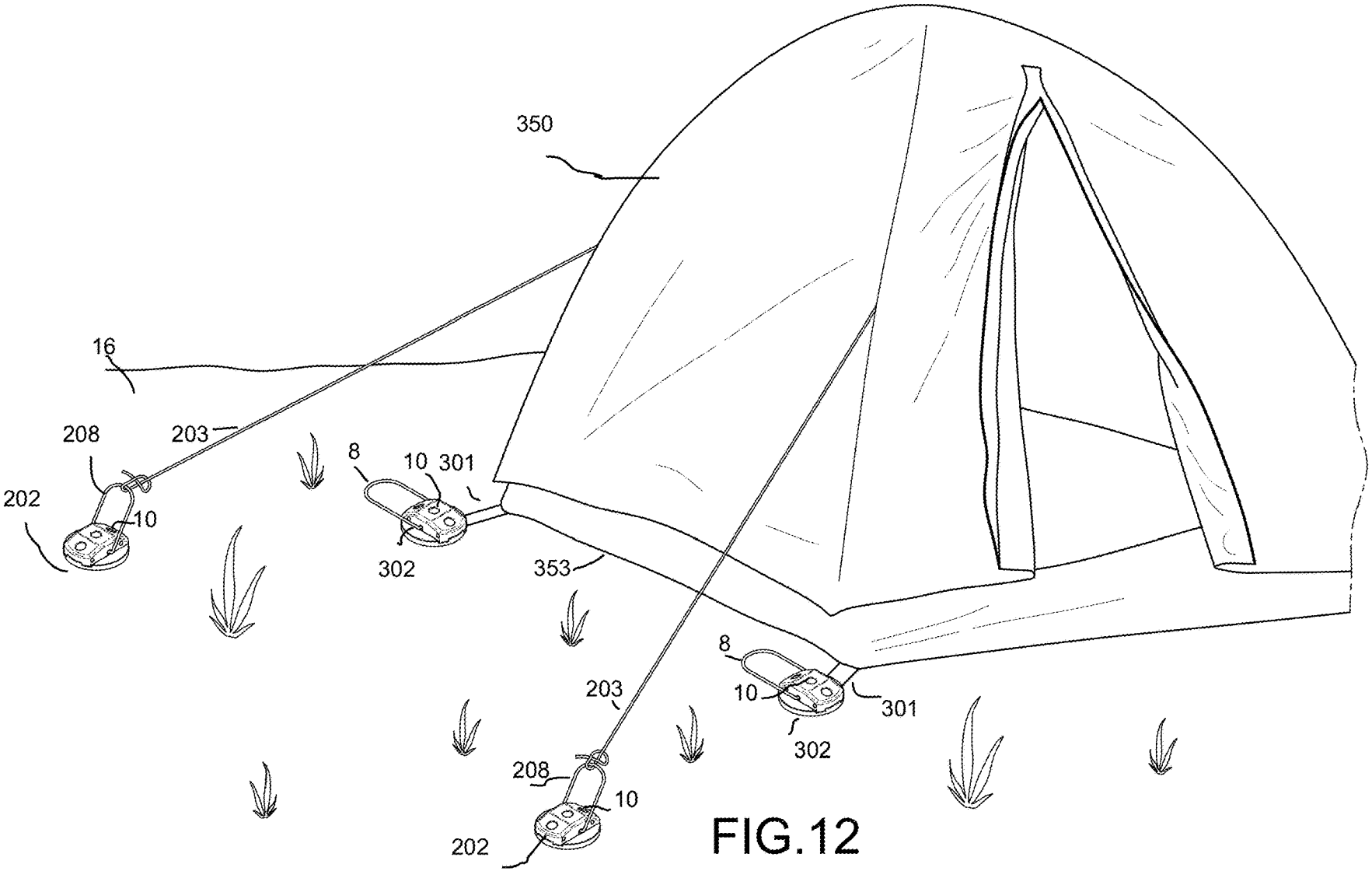
FIG. 12 demonstrates four embodiments of the present invention applied to secure a tent.
Figure 13:
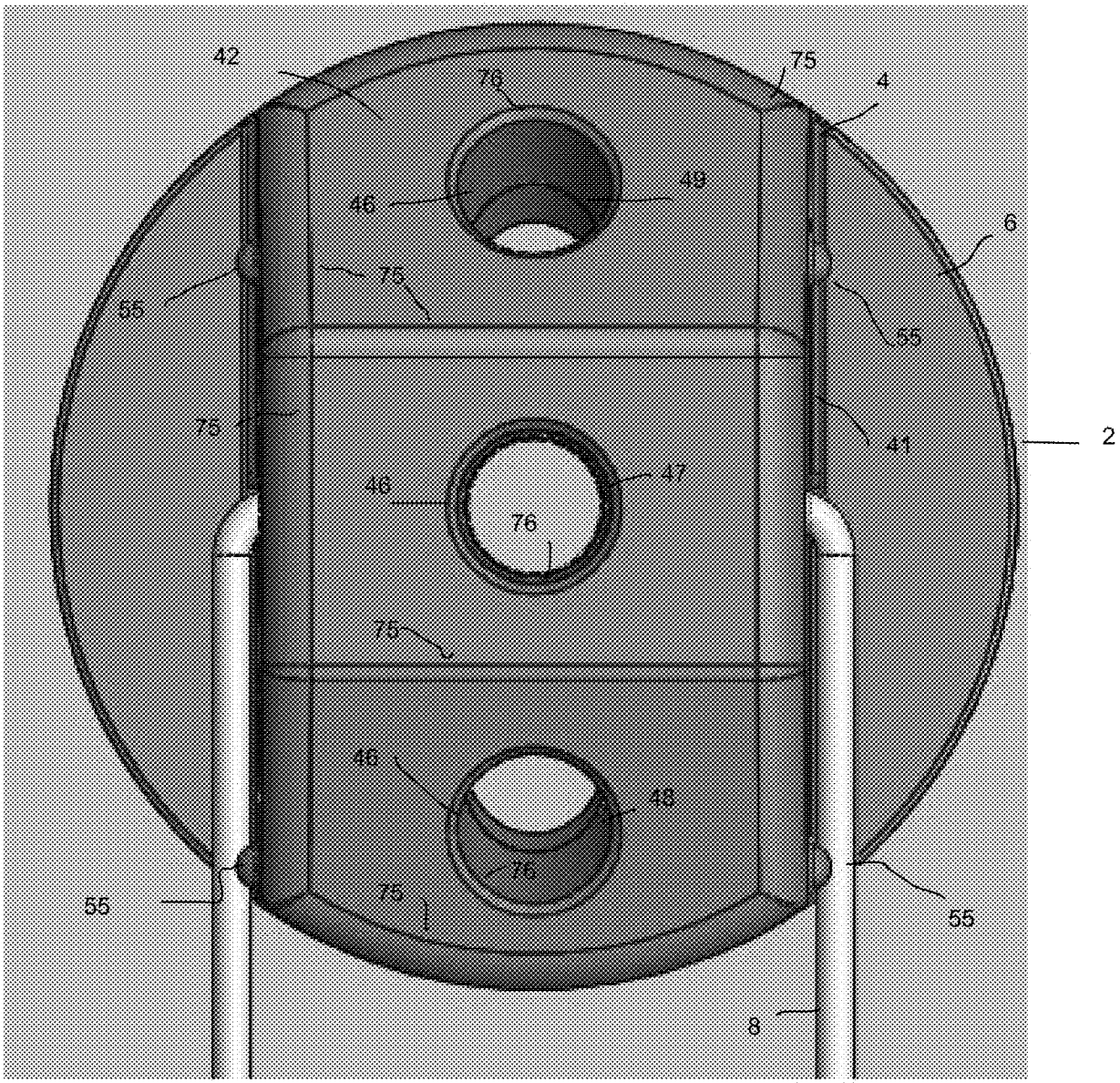
FIG. 13 illustrates a close-up top view of the support with bail attached.

FIGS. 11-12 demonstrate supports with bails engaged were appropriate with various tents 350 while mounted onto ground surface 16. Supports 2 are mounted into the ground via stakes. As shown in FIG. 11, supports 302 may engage flaps 301, by driving stakes 10 through supports 302 and through apertures in flaps 301. Additionally, bails 308 may engage support loops 303 from tent 350 or tent canopy 351. As shown in FIG. 12, distance supports 202 may be engaged at a distance from the tents by tying bales 208 to tent canopy strings 203 or rain guards. Closer supports 302 engage flaps 301, and may include the stake 10 set through support 2 and through aperture in flaps 301. As shown, closer supports can be rotated so that bales 8 are set perpendicular to the edges 353 of the tents to allow for ease of removal. Alternatively, the supports may be rotated for removal.

Figure 14:
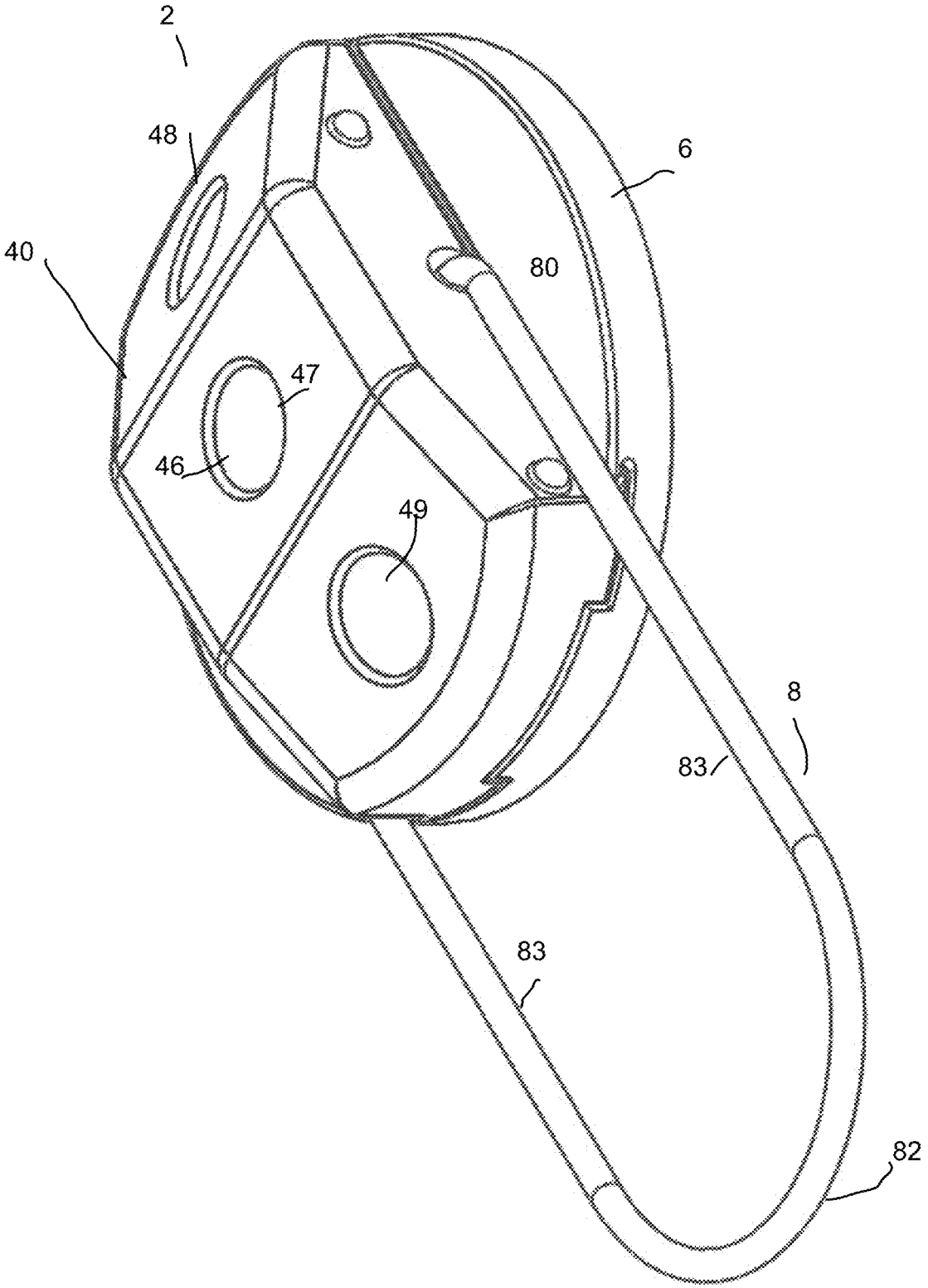
FIG. 14 illustrates a top perspective view of the stake unit.
Figure 15:
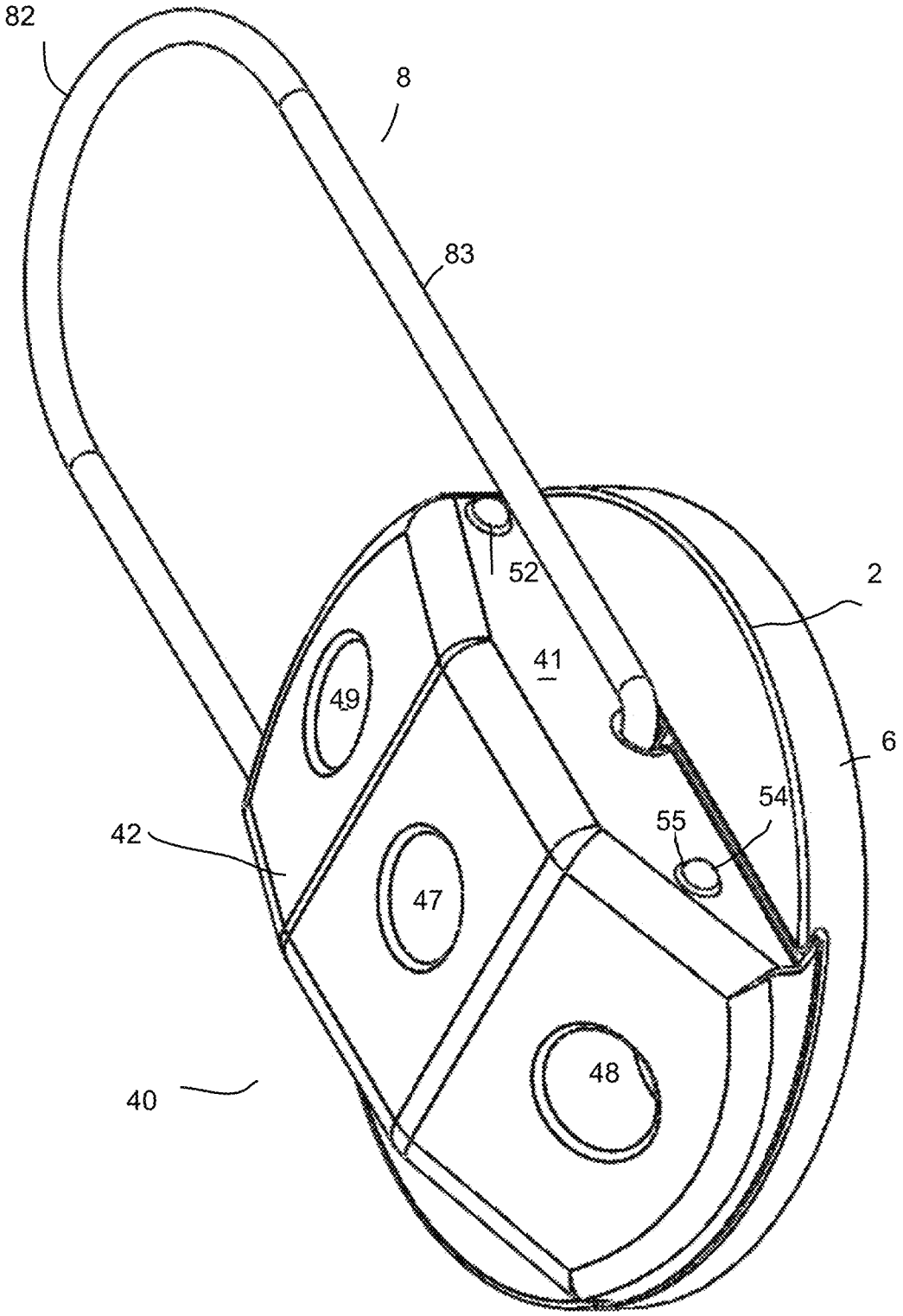
FIG. 15 illustrates a top perspective view of the stake unit of FIG. 12 with the bail rotated 180°.
Figure 16:
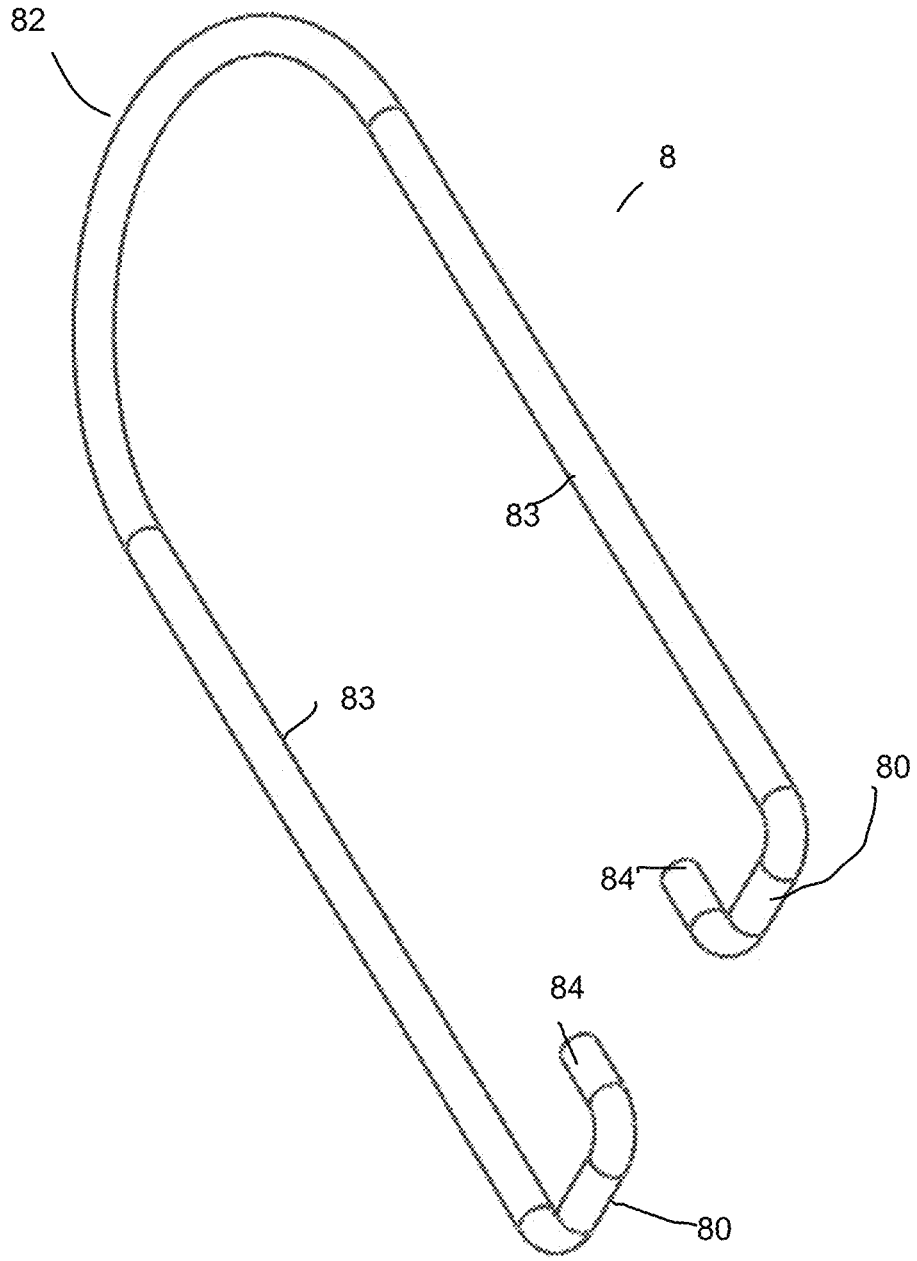
FIG. 16 illustrates an embodiment of a bail unit.
Figure 17:
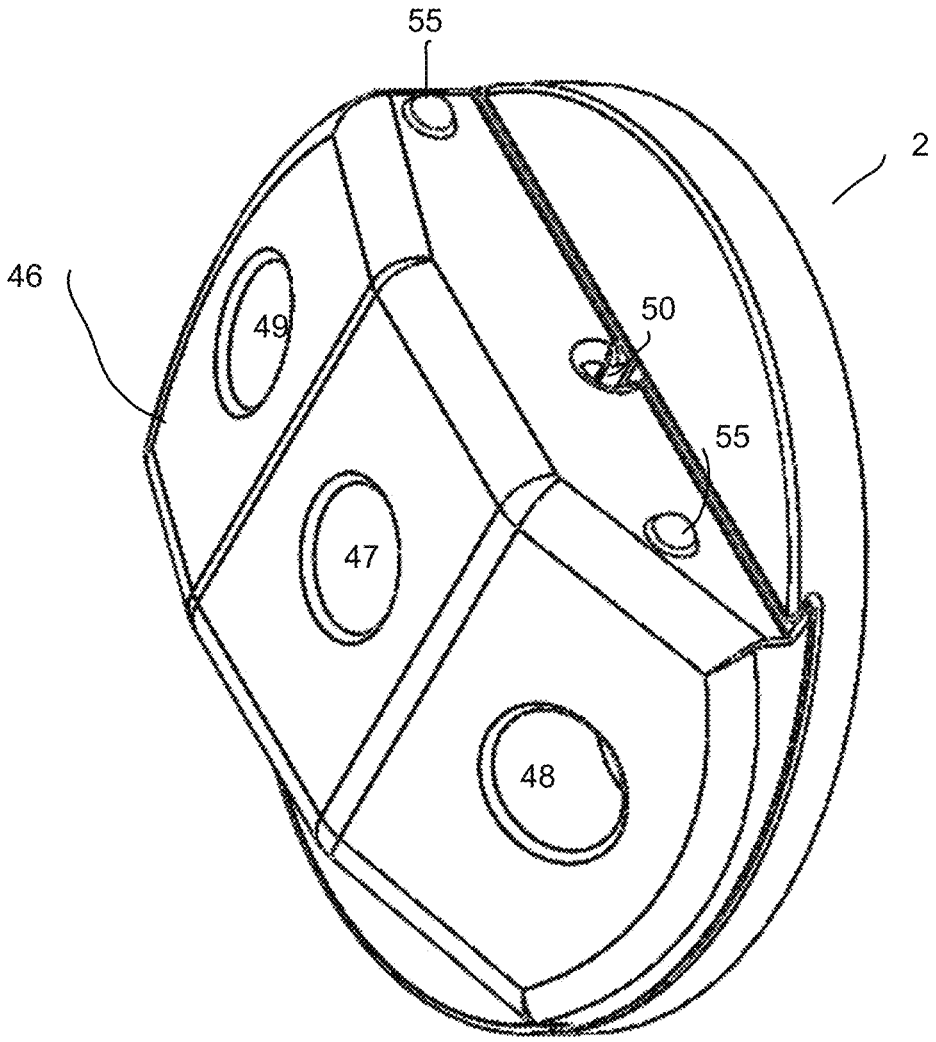
FIG. 17 illustrates a top perspective view of the support without a bail.
Figure 18:
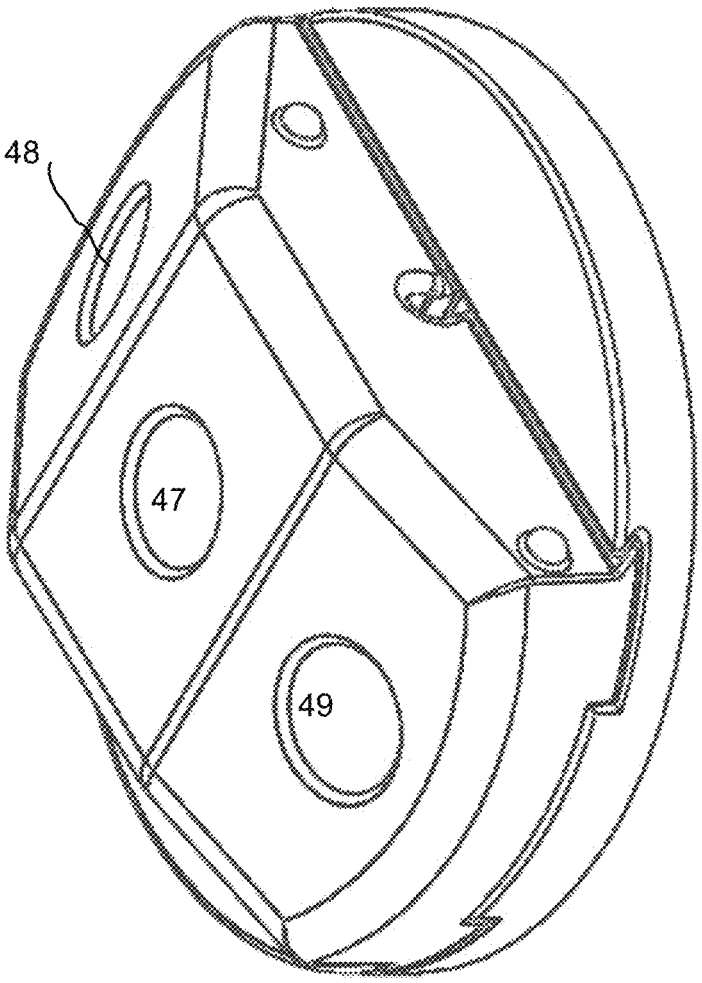
FIG. 18 illustrates a rear perspective view of the support of FIG. 15 rotated 180°.

As shown in FIGS. 13-15 and 17-18, support 2 includes upper 4 and lower 6. Bail 8 may be affixed around upper or pinched between upper and lower. Nubs 55 may include a set of forward nubs 52 and rear nubs 54 to allow for securing bail against lower. Preferably, bail 8 is snug against sides 41 of upper 40. Upper 40 includes sides 41 and multi-faceted top 42. Upper guides 46 include a center guide 47 as well as forward shallow guide 49 and rear steep guide 48. In preferred embodiments, a variety of angles may be formed as between flat, shallow, and steep guides, with preferred angles including a flat zero-degree guide, a shallow guide at fifteen degrees (15°), and a steep guide at thirty degrees (30°). In alternative embodiments, all guides may be offset from ground surface. In further alternative embodiments, shallow guides may be set between 5°-45°, while steep guides may be set between 15°-75° as may be needed for this specific use. As shown in FIG. 11, upper 4 may include draft edges 75, and guides 46 may include drafted holes 76 to allow for molding process (as shown). As shown in FIG. 14, bail 8 may include turned ends 80 to allow for fitting into support 2 (not shown). Bail 8 preferably includes peak 82, and sides 83, and is most preferably made of a spring steel material. Furthermore, hooks 84 may be included to secure bail into support, such as upper to avoid removal of bail when upper and lower are affixed to one another. Alternatively, a cord, or loop as otherwise known in the art, of spring steel woven cord, steel rope, cable, or otherwise, may be used as bail. In such embodiments, bail will not include hooks but will include a continuous loop.

Figure 19:
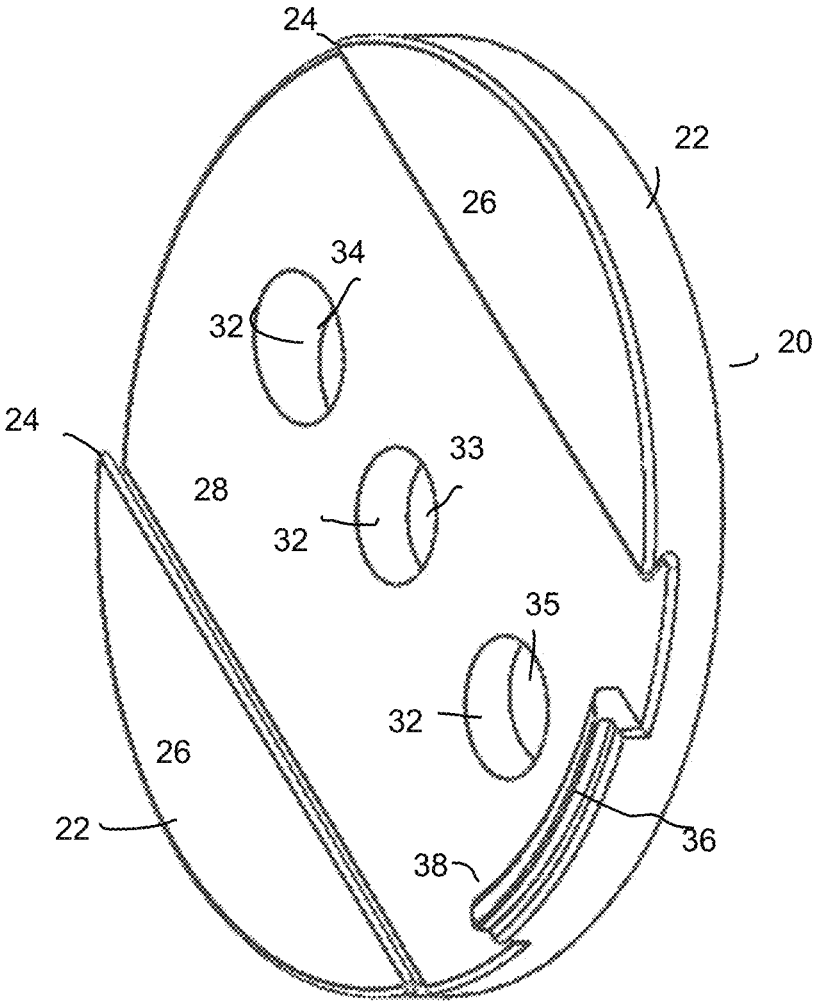
FIG. 19 illustrates a perspective view of the support.
Figure 20:
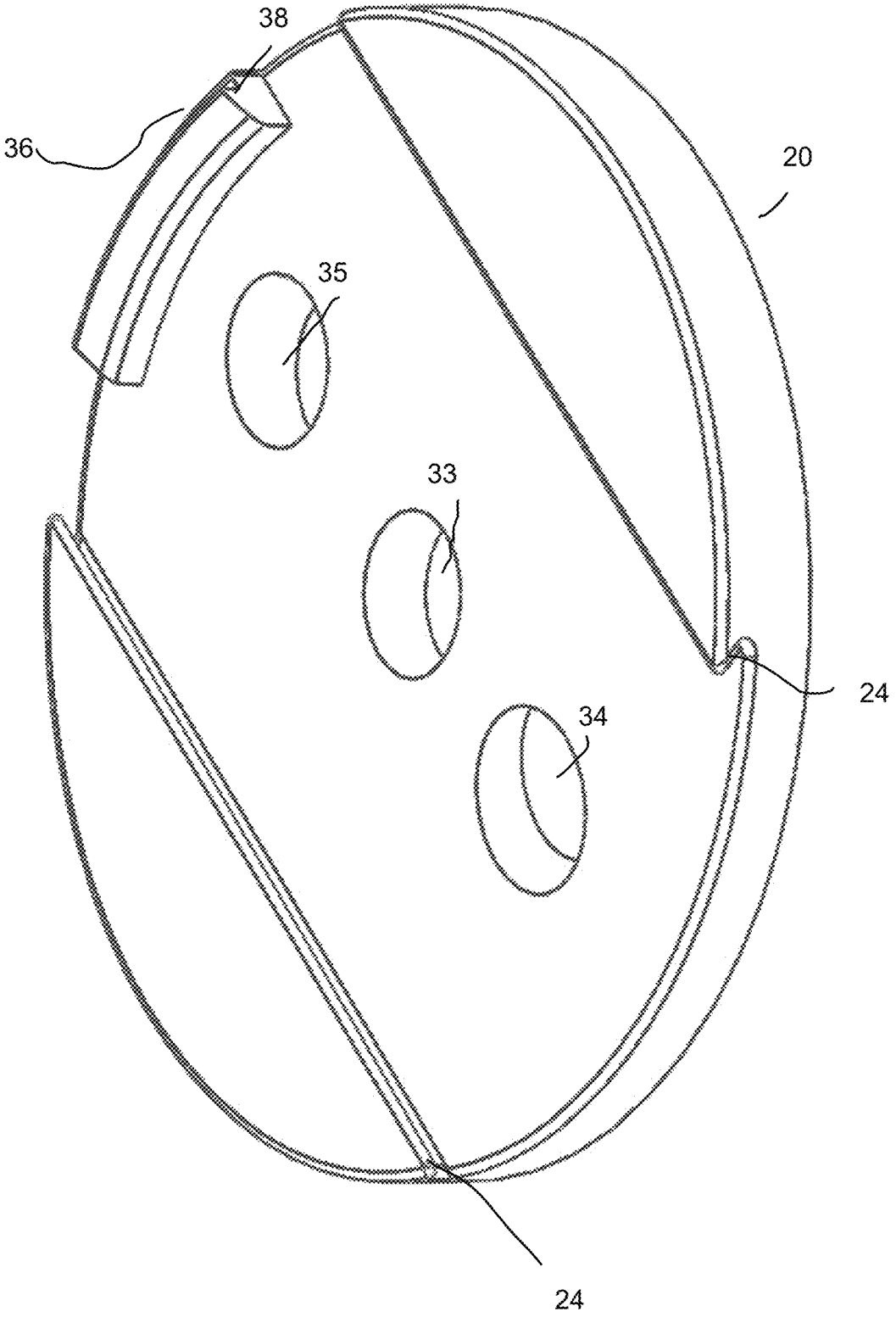
FIG. 20 illustrates a perspective view of the support of FIG. 17 rotated 180°.

As shown in FIGS. 19 and 20, lower 6 is shown. Isolated lower 20 is shown. Isolated lower 20 acts as base 22 for an upper mounted thereupon. Top 28 supports upper (not shown). Isolated lower 20 includes a circumferential edge at base 22 to allow for ease of rotation, preferably in a circular disk body. Sides 26 preferably include recessed dovetail guides 24 to allow upper to slide therethrough. Isolated lower 20 also includes lower guides 32, including center 33, as well as steep rear guide 34 and shallow forward guide 35, wherein guides serve as apertures with an angle oriented in parallel to guides in uppers. Edge stopper 36 is presented to allow upper to enter rear dovetail, slide through dovetail, and stop at edge stopper 36. Ridge 38 is supplied to compliment upper and provide for snap fitting. Upper and lower may be provided in a single unitary body, wherein the bail (preferably as a single loop) is molded within support body. Alternatively, upper and lower may be manufactured separately and glued or melted together after inclusion of bail between upper and lower.

Figure 21:
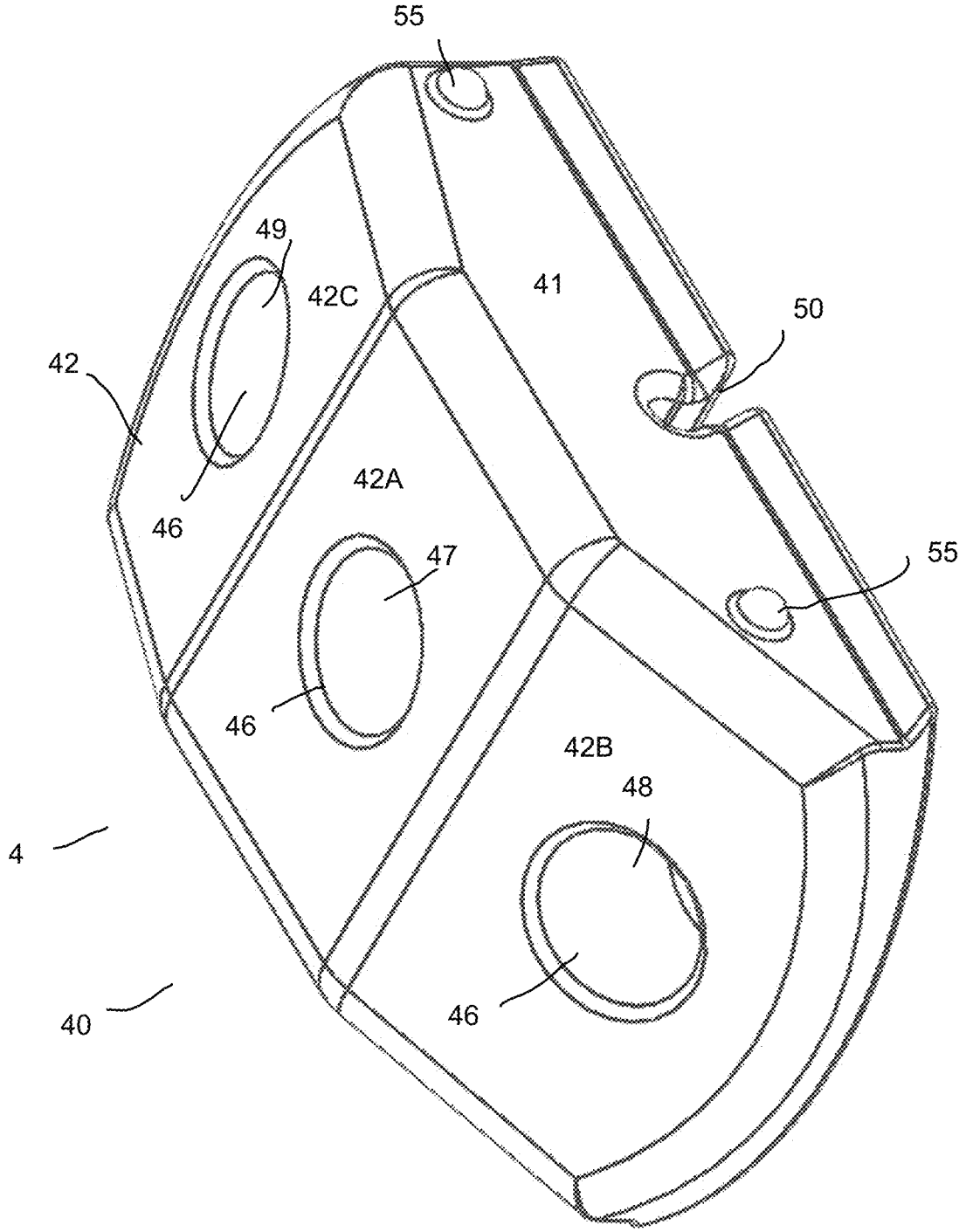
FIG. 21 illustrates a top rear perspective view of the upper of an embodiment of the present invention.
Figure 22:
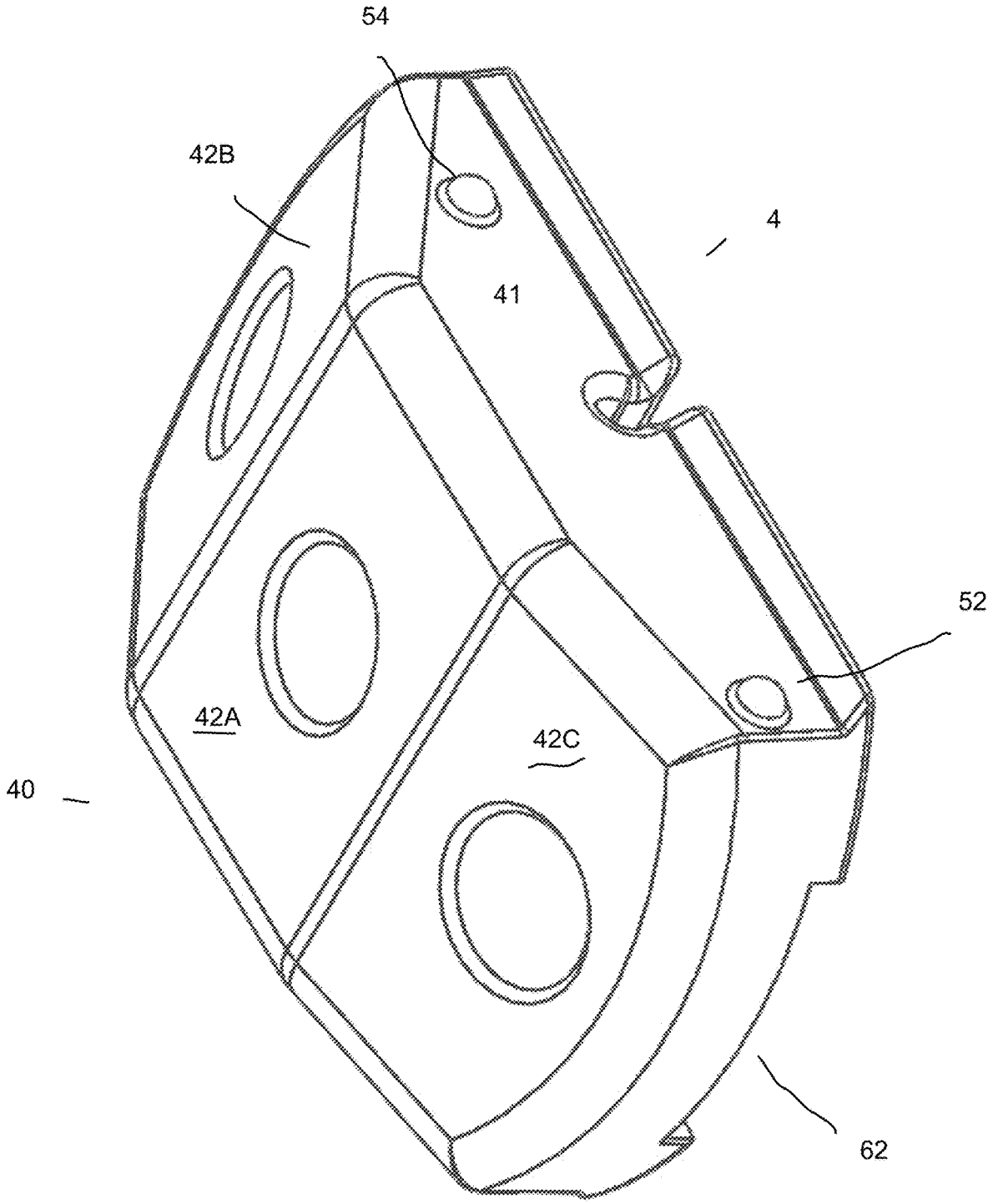
FIG. 22 illustrates a rear top perspective view of an upper of FIG. 19 rotated 180° r

As shown in FIGS. 21 and 22, upper 4 includes isolated upper 40. Isolated upper 40 includes sides 41, and multi-faceted top 42. Isolated upper 40 includes upper guides 46 including central guide 47, rear steep guide 48 and forward shallow guide 49. As shown, center guide is flat, whereas steep guide is set at thirty degrees and shallow guide is set at fifteen degrees off horizontal plane. Each of the guides is set perpendicular to relative top surface, such as central top surface 42A, rear surface 42B, and forward surface 42C. It is contemplated that guides mate at ninety degrees and serve as apertures bored through upper. Nubs 55 include forward nubs 52 and rear nubs 54. Hinge point 50 provides channels 64 to allow bail therethrough. Preferably channels 64 include an open end 65 to allow to affix bail into upper.

Figure 23:
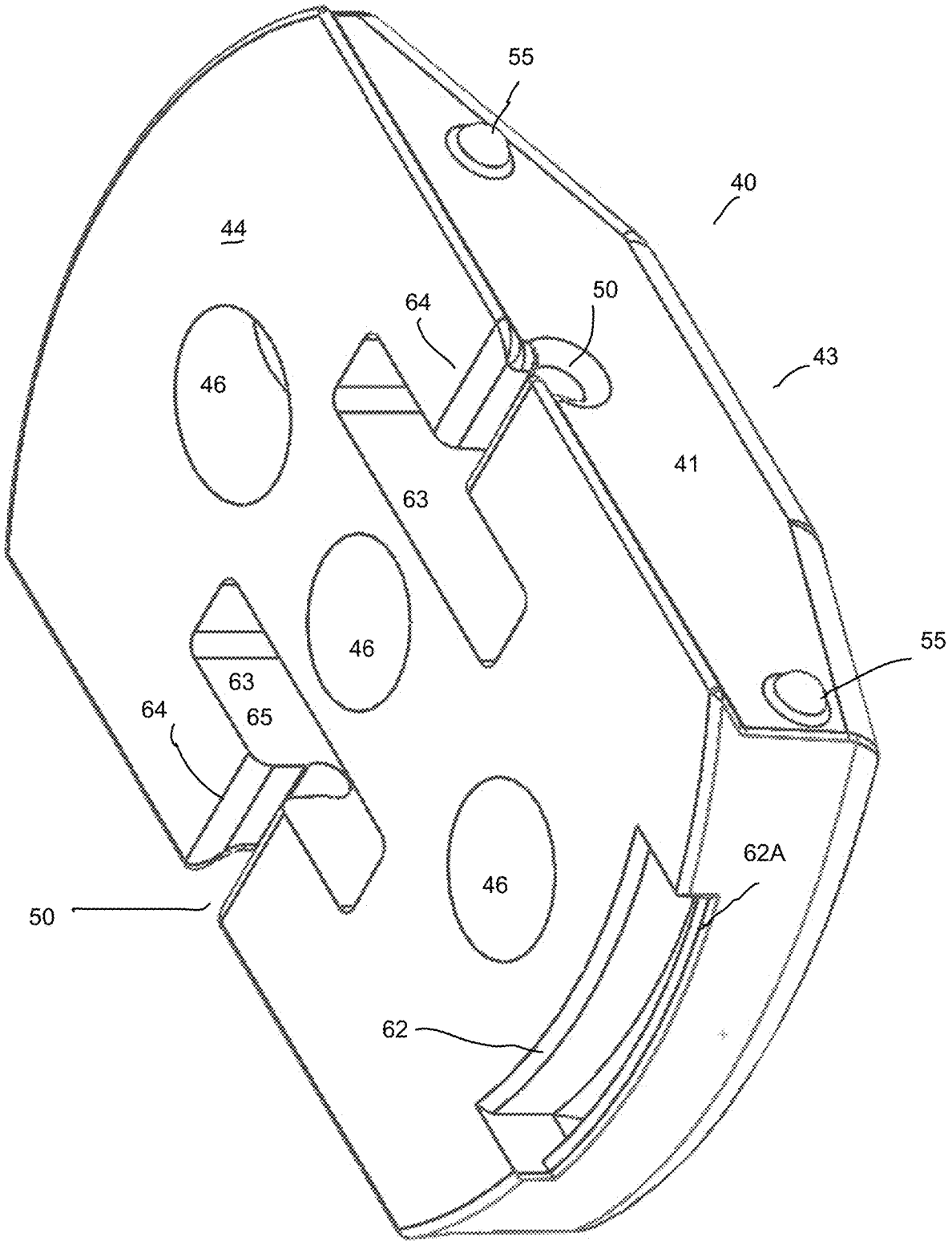
FIG. 23 illustrates a lower perspective view of the upper.

As shown in FIGS. 22-23, bottom 44 of isolated upper 40 is shown. Side 41 is shown along with top surface 42 including central top 42A, rear top 42B, and forward top 42C surfaces. Forward end 61 of isolated upper 40 is shown. Forward end may be affixed onto lower and slid into place. Clip recess 62 is shown with leading extending end 62A to mate with edge stopper and ridge of lower. Upper guides 46 are shown as apertures bored entirely through upper (similar to lower). Channels 64 are provided in sides 41 of isolated upper 40 and channels 64 extend into wells 63. Wells 63 allow for rotation of bail with hooks around and within upper.

While the present invention has been shown and described with various embodiments, the invention extends to further embodiments such as a two or four, etc. faced system. Additionally, a five-faced system with faces angled along the two sides with additional angled entry is considered wherein the aperture channels of the varied faces may intersect within the support. Further, multiple faces may include two or more faces in the same plane to allow for dual (or further) stakes mounted in the ground at the same angle.

I claim:

1. A method for mounting a structure to a ground surface via a stake, said method comprising the steps of:

(a) setting a support onto the ground surface at a first staking location, the support having a base bottom facing the ground surface, while aligning a first aperture through the support over the ground surface at a first angle defining a first axis;

(b) applying a stake through the first aperture;

(c) driving a tip of the stake on a distal end of the stake into the ground surface through the first aperture to cause mating a head of the stake on an opposing proximal end of the stake with a top surface of the support, the head sized larger than the aperture;

(d) hingedly mounting a bail to the support above the ground;

(e) drawing a puller partially through the bail as between the bail and the support;

(f) fixing a far end of the puller against the ground surface at a first distant point;

(g) lifting a near end of the puller, the bail meeting the puller at a first fulcrum point between the near end and the far end; and (h) lifting the near end while simultaneously pushing the far end down utilizing the bail as a lever fulcrum, causing the support to rise with the stake rising out of the ground surface;

wherein the support has an at least first top face, said at least first top face defining a first plane; and wherein said support further comprising an at least second top face, said at least second top face defining a second plane offset by at least five degrees from said first plane, said second top face further comprising a second aperture through said at least second face perpendicular to said second plane.

2. The method of claim 1 further comprising the step of adjusting the puller by resetting the fulcrum to a second fulcrum point between the near end and the far end with the far end set at a second distant point.

3. The method of claim 2 further comprising the step of further lifting the near end of the puller, the bail meeting the puller at a second fulcrum point between the near end and the far end.

4. The method of claim 1 further comprising the step of rotating the support along the ground surface plane along the first axis at least ninety degrees after said step of driving and prior to said step of drawing.

5. The method of claim 1 further comprising completely removing the stake from the ground surface.

6. The method of claim 5 further comprising the steps of:

(a) setting the support base bottom onto the ground surface at a second staking location while aligning a second aperture through the support over the ground surface at a second angle, the second angle being offset from the first angle within the support by at least five degrees;

(b) applying the stake through the second aperture;

(c) driving a tip of the stake into the ground surface through the second aperture to cause mating a stake head with a top surface of the support;

(d) hingedly mounting a bail to the support above the ground;

(e) drawing a puller partially through the bail as between the bail and the support;

(f) fixing a far end of the puller against the ground surface at a further distant point;

(g) lifting a near end of the puller, the bail meeting the puller at a first fulcrum point between the near end and the far end; and (h) lifting the near end while simultaneously pushing the far end down utilizing the bail as a lever fulcrum, causing the stake to rise out of the ground surface.

7. The method of claim 1 whereby said step of hingedly mounting the bail, sets a bail hinge axis in a horizontal plane said horizontal plane perpendicular to said first axis.

8. The method of claim 4 wherein said step of rotating the support along the ground surface plane is conducted parallel the ground surface.

9. The method of claim 1 whereby said step of setting the support comprises extending the aperture between a top surface of the support and a bottom surface of the support, the bottom surface facing the ground.

10. The method of claim 1 whereby said step of hingedly mounting the bail comprises attaching a curved wire with two hooked ends, and emplacing the two hooked ends into recesses along the support.

11. The method of claim 1 whereby said step of setting comprises emplacing a lower portion of the support onto the ground, and securing an upper portion of the support on the lower portion to mate the lower and upper portions.

12. The method of claim 11 whereby said step of securing aligns an upper guide in the upper portion with a lower guide in the lower portion to form the first aperture.

13. The method of claim 1 whereby said step of hingedly mounting the bail comprises attaching a contiguous loop to the support.

14. The method of claim 1 further comprising the step of affixing a looped tent cord to said bail.

15. The method of claim 14 whereby said step of affixing is conducted prior to said step of hingedly mounting.

16. The method of claim 1 whereby said step of driving forces the stake through an aperture in a tent structure.

17. The method of claim 1 further comprising the step of laying the bail flat and locking the bail in a down flat position by forcing the bail below at least one nub extending from a side wall in the support.

18. The method of claim 1 whereby the first plane is horizontal and said step of setting causes a first and second axis defined by the first and second apertures to offset by at least five degrees.

19. A method for mounting a structure to a ground surface via a stake, said method comprising the steps of:

(a) setting a multi-faceted support onto a ground surface by setting a base bottom onto the ground surface at a first staking location, and sliding an upper portion onto the base bottom to mount the upper portion onto the base bottom;

(b) aligning a first aperture through the multi-faceted support over the ground surface at a first angle defining a first axis;

(c) aligning a second aperture through the multi-faceted support over the ground surface at a second angle defining a second axis, the first axis offset the second axis by at least five degrees;

(d) applying the stake through the first aperture;

(e) driving a tip of the stake into the ground surface through the first aperture;

(f) hingedly mounting a bail to the multi-faceted support above the ground;

(g) drawing a puller partially through the bail as between the bail and the multi-faceted support;

(h) fixing a far end of the puller against the ground surface at a first distant point;

(i) lifting a near end of the puller, the bail meeting the puller at a first fulcrum point between the near end and the far end; and (j) lifting the near end while simultaneously pushing the far end down utilizing the bail as a lever fulcrum, causing the support to rise and thereby lifting the stake out of the ground surface.

20. The method of claim 19 whereby said step of hingedly mounting sets a hinge axis parallel the ground surface.

21. The method of claim 19 further comprising the steps of:

(a) setting the support base bottom onto the ground surface at a second staking location while aligning a second aperture through the support over the ground surface at a second angle, the second angle being offset from the first angle within the support by at least five degrees;

(b) applying the stake through the second aperture;

(c) driving a tip of the stake into the ground surface through the second aperture to cause mating a stake head with a top surface of the support;

(d) hingedly mounting a bail to the support above the ground;

(e) drawing a puller partially through the bail as between the bail and the support;

(f) fixing a far end of the puller against the ground surface at a further distant point;

(g) lifting a near end of the puller, the bail meeting the puller at a first fulcrum point between the near end and the far end; and (h) lifting the near end while simultaneously pushing the far end down utilizing the bail as a lever fulcrum, causing the stake to rise out of the ground surface.

22. The method of claim 19 further comprising the step of rotating the multi-faceted support along the ground surface at least ninety degrees after said step of driving and prior to said step of drawing.

* * * * *